US005156272A

United States Patent [19]

Bouchard et al.

[11] Patent Number: 5,156,272

[45] Date of Patent: Oct. 20, 1992

[54] DEVICE FOR DEFACING VALUABLE DOCUMENTS AND CASES FOR AUTOMATIC BANKNOTE DISPENSERS FITTED WITH SUCH DEVICE

[75] Inventors: Carole P. Bouchard, Paris; Daniel G. Deschamps, Montigny le Bretonneux, both of France

[73] Assignee: Fichet Bauche, France

[21] Appl. No.: 735,442

[22] Filed: Jul. 24, 1991

[30] Foreign Application Priority Data

Jul. 26, 1990 [FR] France ..... 90 09570

[51] Int. Cl.[5] ..... B65D 73/00; E05G 1/00

[52] U.S. Cl. ..... 206/495.1; 109/25; 109/29

[58] Field of Search ..... 206/1.5, 205, 425, 459; 109/25, 29, 33, 36

[56] References Cited

U.S. PATENT DOCUMENTS

| | | | |
|---|---|---|---|
| 1,369,179 | 2/1921 | Lee | 109/33 |
| 2,829,608 | 4/1958 | Blackburn et al. | 109/33 |
| 3,739,412 | 3/1974 | Di Paola et al. | 109/29 |
| 4,461,222 | 7/1984 | Brunner et al. | 109/29 |
| 4,607,579 | 8/1986 | Stenild | 109/3.3 |
| 4,610,806 | 9/1986 | Rosen | 109/25 |
| 4,712,489 | 12/1987 | Levavasseur | 109/33 |
| 4,722,435 | 2/1988 | Mareels et al. | 206/1.5 |
| 4,799,435 | 1/1989 | Boutroy | 109/25 |
| 4,848,246 | 7/1989 | Rosen | 109/25 |
| 4,852,502 | 8/1989 | Klingberg et al. | 109/25 |

FOREIGN PATENT DOCUMENTS

| | | |
|---|---|---|
| 0166639 | 7/1986 | European Pat. Off. . |
| 190778 | 8/1986 | European Pat. Off. . |
| 0347091 | 12/1989 | European Pat. Off. . |
| 2583455 | 12/1986 | France . |
| WO8302975 | 9/1983 | PCT Int'l Appl. . |
| 1138104 | 12/1968 | United Kingdom . |
| 2006322 | 5/1979 | United Kingdom . |

*Primary Examiner*—David T. Fidei

*Attorney, Agent, or Firm*—Ostrolenk, Faber, Gerb & Soffen

[57] ABSTRACT

A device for blurring valuable documents such as banknotes includes means for delivering a blurring or discoloring liquid to deface banknotes contained within an enclosure upon a breach of security afforded by the enclosure. At least one spongy element placed close to the edges of the banknotes which are stacked on edge in the enclosure with which is associated a tank for defacing liquid. Upon the occurrence of a breach the defacing liquid soaks the spongy element which engages the upper cut edges of the banknotes to allow the defacing liquid to migrate on and between the cut edges of these banknotes stored within the enclosure. The device is particularly applicable to cash boxes for automatic bank bills dispensers.

16 Claims, 3 Drawing Sheets

DEVICE FOR DEFACING VALUABLE DOCUMENTS AND CASES FOR AUTOMATIC BANKNOTE DISPENSERS FITTED WITH SUCH DEVICE

BACKGROUND OF THE INVENTION

The present invention relates essentially to a device for defacing by blurring or staining, valuable documents such as banknotes or bills.

It is also directed to case-like containers or boxes for automatic banknote dispensers fitted with this device for defacing etc.

The resistance of automatic banknote dispensers on public ways to burglary gives rise to substantial difficulties.

Nowadays not only burglars are attacking such appliances in an attempt to extract or remove therefrom the bill or cash boxes they contain but, more burglars are employing and more big building or works site rigs, machines or like equipment for dislodging, by "hammering blow or ramming strokes", the whole contrivance from the wall which it is secured or fastened. After having thus removed or withdrawn the apparatus. The burglars working in a hidden or concealed place, easily break the contrivance open to withdraw therefrom the cash boxes and the money therein.

Various solutions have been contemplated to cope with such an intolerable situation. In one solution after it is detected that there has been a breach of the container, the banknotes or other documents therein are rendered unusable or worthless for the thieves without destroying them completely in order that they be repayable or refundable by the Banque of France.

All the solutions however proposed until now for safes or strong-boxes, money-carrying bags or similar enclosures are dangerous and may not be suitable for bank bill dispenser which are relatively sophisticated apparatus.

Thus, currently known pyrotechnical solutions may be dangerous for the persons in the vicinity of the system and also may destroy the surroundings or environment of the system.

There are also complex mechanical solutions aimed at partially destroying the banknotes by perforating same. These complex systems generally require a good deal of power and when falsely started or set in operation during a handling thereof may provide to be dangerous for the operator. Moreover the system runs the risk of choking, stopping, blocking or clogging which is particularly awkward in the case of automatic banknote dispensers which, by themselves, are relatively complicated systems comprising sophisticated electronic equipment.

More recently chemical solutions have been devised which generally consist in using discoloring means such as smoke generators for blurring or staining the banknotes. These products however are likely to impair the environment, and in particular the electronic system in the container of a bank bill dispenser. Furthermore these chemical systems mark the banknotes on their cut edges only, i.e. very locally.

SUMMARY OF THE INVENTION

The object of the present invention is therefore to cope with the inconveniences referred to hereinabove by providing a device for defacing by blurring or discolouring or fading, the banknotes by providing a novel apparatus that is particularly reliable and is not likely to damage the environment of the apparatus using it, which is not likely to be dangerous upon mishandling of the apparatus and which performs a substantial marking on all the banknotes in the event of breach irrespective of the position of the system during or after the breach.

For that purpose the subject of the instant invention is a device for blurring or staining valuable documents such as banknotes stored or stacked in an enclosure, which device comprises means adapted to deliver a blurring or staining or discolouring liquid to the documents in the enclosure that is subjected to an unauthorized entry or breach. Such means consist of at least one spongy element which is arranged in close proximity to the edges of the documents stored and stacked or piled up in the enclosure, and with which is associated at least one blurring liquid tank. In case of a breach the liquid soaks the spongy element, coming in contact with the cut edges of the documents to allow the migration of the blurring liquid on and between the cut edges of the documents stored and stacked or piled in the enclosure.

According to another characterizing feature of this invention the aforesaid tank is incorporated into the spongy element which is interposed between the cut edges of the documents and a fluid-tight wall, such as a cover or lid of the enclosure, and assumes the shape of one or several frangible pockets, phials, ducts or the like.

The aforesaid tank may be associated at least one heating resistor wire or a pyrotechnical means, or may be associated with a mechanical means for causing perforation of the tank when there is a break in.

The aforesaid tank embodied into the spongy element may be arranged in sandwich-like fashion between two metal plates one of which carries sharp pins or points or the like that are used for perforating the tank.

According to another embodiment the aforesaid tank is located outside of the spongy element which contains at least one pocket or a plurality frangible tubes connected to this tank.

In this case, upon the occurence of a breach, the blurring liquid contained in the tank is injected into the pocket or the tubes by a gas under pressure or by a piston slidably mounted within the tank. The aforesaid tank may be accommodated or housed inside of an enclosure or located outside of this enclosure.

According to a further characterizing feature of the invention the aforesaid enclosure is a case or container-like, for an automatic banknote dispenser.

All the bill boxes of a bank note dispenser are fitted with document defacing devices constructed according to the invention so that in case of unauthorized removal of the dispenser the banknotes contained within these cash boxes would become unusable by the thieves, because they would be strongly soaked with blurring and indelible liquid.

The invention will be better understood and further objects, characterizing features, details and advantages thereof will appear more clearly as the following explanatory description proceeds with reference to the accompanying diagrammatic drawings given by way of non limiting examples only illustrating presently preferred the specific embodiments of the invention and wherein:

DETAILED DESCRIPTION OF THE INVENTION

Figure 1:
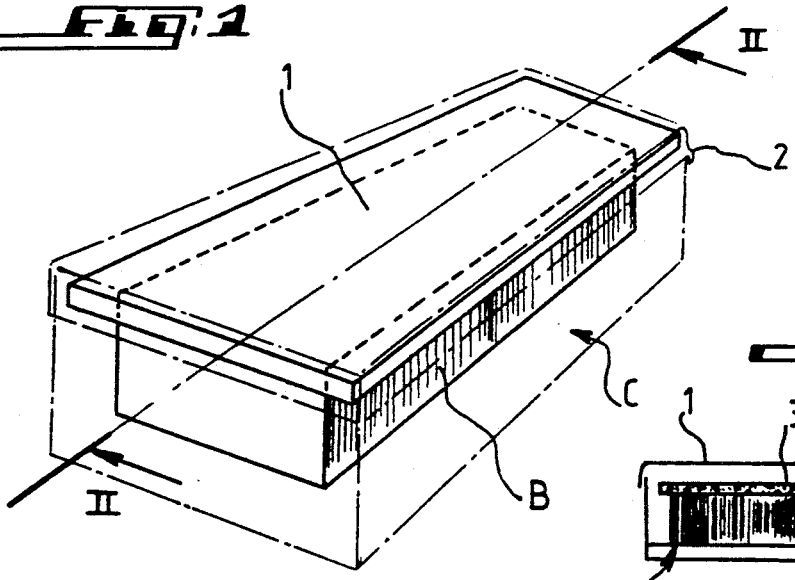
FIG. 1 is a diagrammatic perspective view of a cash box for a banknote dispenser.
Figure 2:
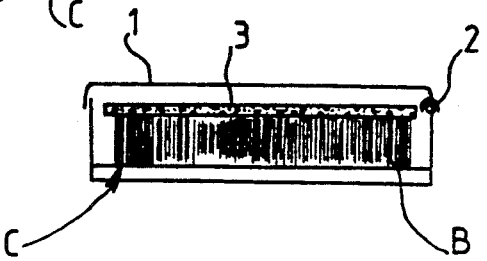
FIG. 2 is a view in section taken upon the line II—II of FIG. 1.
Figure 3:
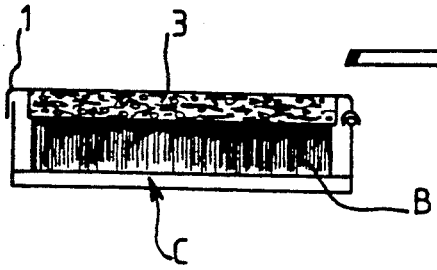
FIG. 3 is a view like FIG. 2 but showing the content of the cash box after a breach.

Referring to FIGS. 1 to 3 illustrating the principle of the invention, there is shown a bill or cash box C for an automatic banknote dispenser, this box comprising a cover or lid 1 pivotally connected by a hinge 2 and containing a plurality of vertically stacked banknotes B.

The invention could quite well be applicable to a banknote container other than a cash box and such for instance as a safe or strong-box or a fund of money carrying bag.

According to the invention a spongy element 3 made from any suitable material and likely to provide for retaining or holding a blurring or staining liquid and which is interposed between the cover 1 and the plane formed of the upper cut edges of the banknotes B. Thus, the spongy element 3 receiving the blurring liquid to be delivered upon a breach, from a tank which will be described hereinafter, will soak the spongy element 3. The latter will swell and as well seen on FIG. 3 will be allowed to soak the cut edges of the bank notes B and will deliver liquid that migrates through capillarity between the bank notes in order to provide for a substantial marking thereof which defaces the bank notes so that they become unusable by the thieves.

Figure 4:
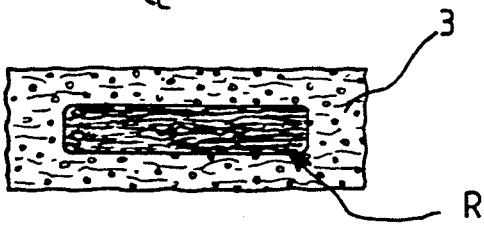
FIG. 4 is a sectional view of a spongy element with a tank incorporated therein.

As shown in FIG. 4, tank R incorporated into the spongy element 3 is filled with a blurring liquid which is of any suitable composition. In particular, the blurring liquid may contain a solvent, a colouring matter or dye or possibly a fixer. Such blurring liquid will act very quickly through capillarity for soaking the banknotes B. Without departing from the scope of the invention a discolouring or fading liquid composition may be used to alter or to remove at least in part the colours from the banknotes.

Figure 5:
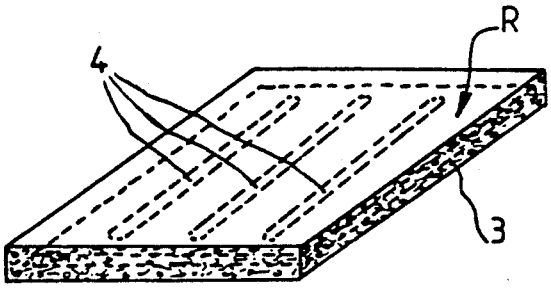
FIGS. 5 to 7 show perspective views, respectively, of three alternative embodiments or modifications of the tank embodied into the spongy element.

According to the embodiment shown on FIG. 5 the tank R assumes the shape of a relatively flexible or yielding pocket comprising fine frangible portions 4 adapted to break under the effect of a breach by a means to be described later and when this occurs a blurring liquid is delivered to the spongy material of the element 3.

Figure 6:
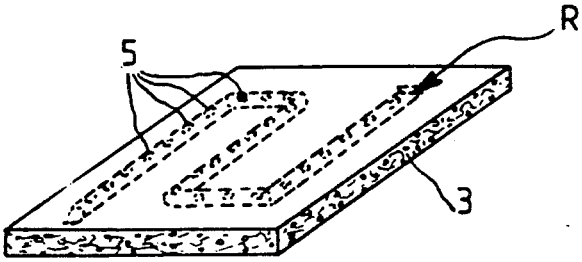

According to the alternative embodiment shown on FIG. 6, the tank R incorporated into the spongy element 3 assumes the shape of a worm-like member including, throughout its length, small brittle portions 5 that permits a blurring liquid product to be delivered to the spongy element 3 when the liquid product is pressurized.

Figure 7:
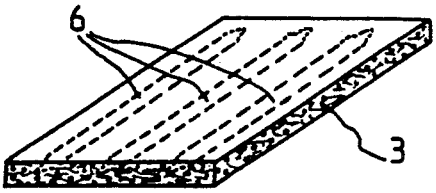

In the embodiment of FIG. 7 the tank integrated into the spongy element 3 consists of phials 6 that are breakable upon a breach.

Figure 8:
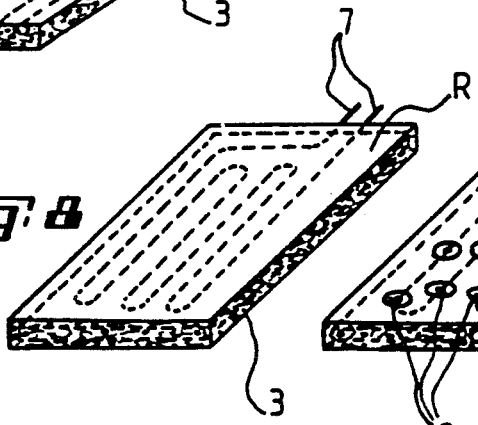
FIG. 8 is a perspective view of a spongy element with a tank incorporated therein with which is associated a heating resistor wire.

In the case where the tank R consists of one or more flexible or yielding pockets made, for instance, from a synthetic or plastics material which may assume any shape whatsoever. As shown FIG. 8 it is possible to make use of a heating resistor wire 7 which will be energized to carry electric current, upon the occurrence of a breach, in order to fuse or melt through the wall of tank containing a defacing liquid.

Figure 9:
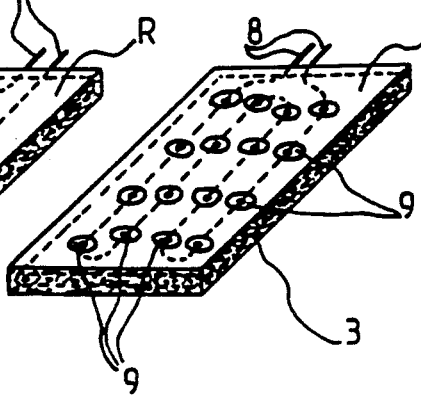
FIG. 9 is a view similar to FIG. 8 but showing a pyrotechnical system associated with a tank.

It is also possible, as shown on FIG. 9, to associate with the tank R embodied into the spongy element 3, a match or fuse 8 connected to small pinpoint blasting or explosive charges 9 adapted to burst local area in the wall of the tank R.

Figure 10:
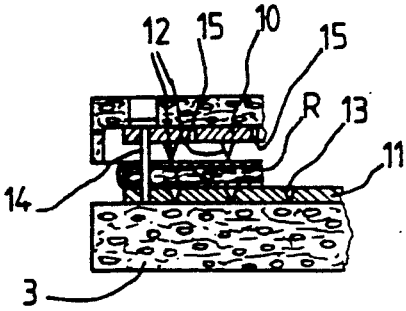
FIG. 10 is partial diagrammatic view in section of a spongy element with a tank which may be perforated by a mechanical system.
Figure 11:
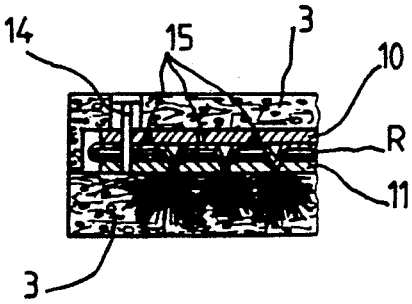
FIG. 11 is a view like FIG. 10 but showing the mechanical system in operation upon a breach.

As shown on FIGS. 10 and 11 the tank R incorporated into the spongy element 3 may be arranged in sandwich-like fashion between two metal plates 10, 11 one of which (plate 10) 00, carries points, sharp pins or the like, in this spikes 12, adapted to perforate tank R. The other plate 11 is provided with small holes 13 adapted to receive the points 12. At 14 is a diagrammatic illustration of means in the form of a rod that permits both plates 10, 11 to slide in relation to each other. At region 15 in FIGS. 10 and 11 are shown holes extending through the plate 10 and adapted to supply some blurring product to the spongy element 3 upon a perforation of the tank R under the effect of a breach that causes plates 10 and 11 to move towards each other it being understood that although this has not been shown in FIG. 11, the blurring product wetting the spongy element 3 will soak the banknotes as shown on FIG. 3.

Figure 12:
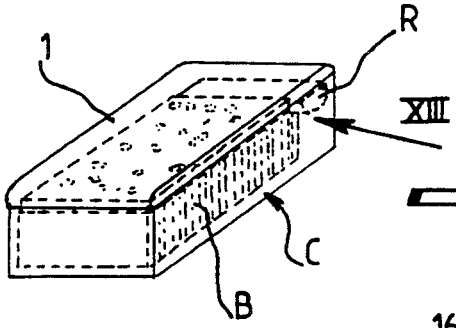
FIG. 12 is diagrammatic perspective view of a cash box for a banknote dispenser and containing a tank located outside of the spongy element.
Figure 13:
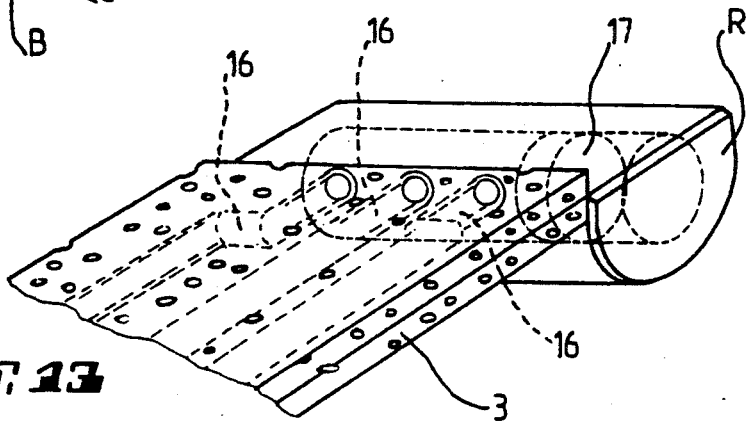
FIG. 13 is a perspective and enlarged view of the portion XIII of FIG. 12.

According to the alternative embodiment illustrated in FIGS. 12 and 13, the tank R is located outside of the spongy elements 3 which contains tubes or pipes 16 connected to this tank R. Upon a breach the blurring liquid contained within the tank R is injected into the tubes 16 by a gas under pressure or by a piston 17 that slides within the tank R. As previously described, the blurring liquid injected into the tubes 16 causes these tubes 16 to burst locally so that the blurring liquid will be delivered to the spongy element 3.

Figure 14:
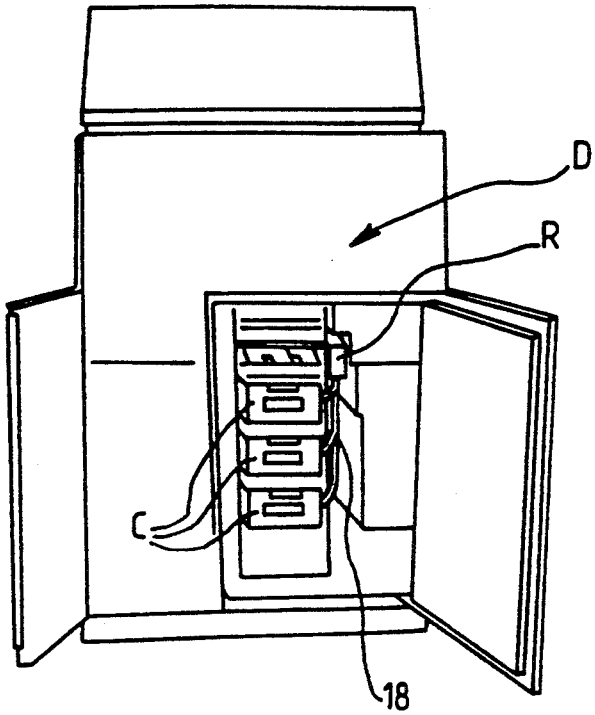
FIG. 14 is perspective front view of an automatic banknote dispenser.
Figure 15:
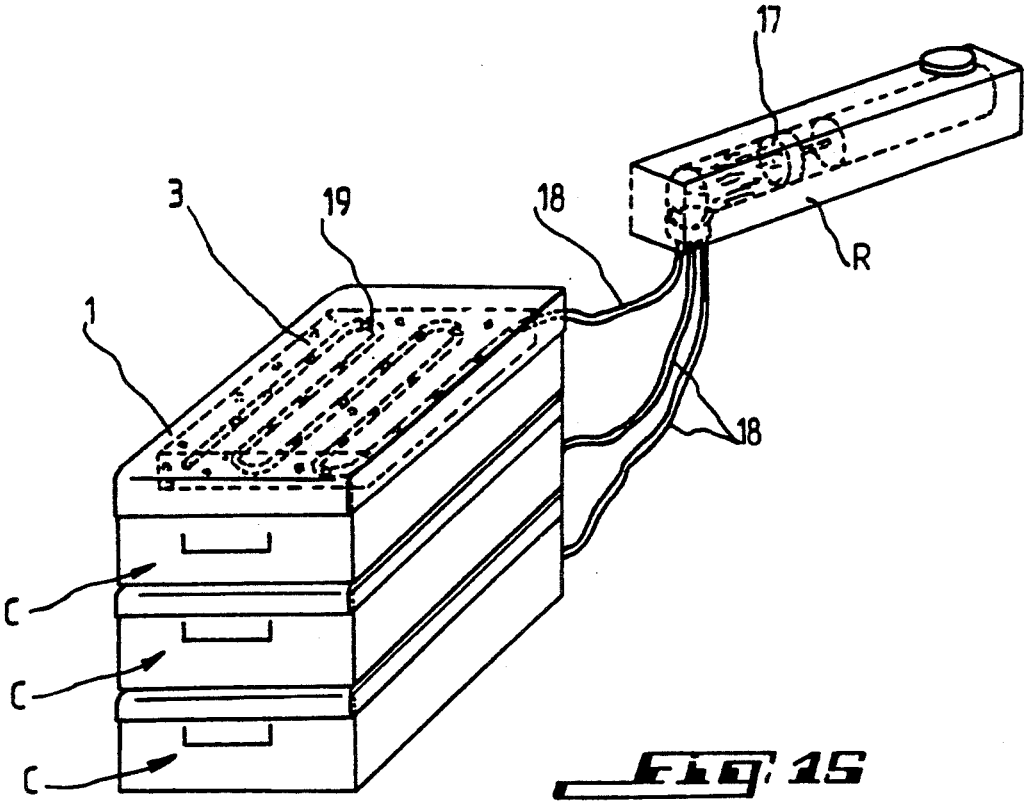
FIG. 15 is perspective view of a stack or pile of cash boxes receivable in this dispenser and with which is associated a blurring liquid tank located outside of said boxes.

As shown in FIGS. 14 and 15 according to another embodiment the tank R is located outside of the said boxes C and is connected thereto by flexible ducts 18. Thus, one single tank R having sliding piston 17 therein acts upon the occurrence of a breach to feed several boxes contained within an automatic dispenser D for banknotes B.

According to the exemplary embodiment shown in FIG. 15 each of the boxes C encloses a spongy element 3 interposed between the cover or lid 1 of each box C and the cut edges of the banknotes arranged closedly spaced from lid 1, with said spongy element 3 including a worm-shaped tube or pipe 19 connected by the flexible ducts or hoses 18 to the tank R.

It has therefore being provided according to the instant invention a device for defacing as by blurring or staining, banknotes which remains clean and harmless, may not be dangerous during handling of the boxes and allows the banknotes to be effectively soaked so that they become unstable by the thieves and this without being dependent upon the positions of the boxes hence of the gravity or own weights.

The invention is of course not at all limited to the embodiments described and illustrated which have been given by way of examples only.

On the contrary the invention comprises all the technical equivalents of the means described as well as their combinations if the latter are carried out according to its gist and within the scope of the appended claims.

What is claimed is:

1. In combination, an enclosure, a plurality of documents disposed within the enclosure, and a device associated with said enclosure for defacing said documents when security afforded by said enclosure to said documents is breached;

each of said documents being bounded by cut edges, said documents being disposed in generally vertical planes and being arranged face-to-face in a stack having an upper surface;

said device including a spongy element disposed above said stack in close proximity to the upper surface thereof, a tank operative associated with said element, and a defacing liquid normally stored in said tank;

said liquid being released to soak said element upon breaching of said security whereby said liquid migrates through said element to said upper surface, and contacts those of said cut edges that are disposed at said upper surface and migrates between said documents to deface same.

2. A combination according to claim 1, wherein the said tank is incorporated into the spongy element and the latter is interposed between the top surface of the stack and a fluid-tight wall of the enclosure and assumes the shape of at least one frangible pocket.

3. A combination according to claim 2, wherein with said tank is associated with first means that causes perforation of the tank when there is a breach of said security.

4. A combination according to claim 1, wherein said tank is incorporated into said spongy element and is arranged in sandwich-like fashion between first and second metal plates one of which carries protrusions adapted to perforate said tank.

5. A combination according to claim 1, wherein said tank is located outside of the spongy element and the latter contains pocket means operatively connected to said tank.

6. A combination according to claim 5, wherein the defacing liquid contained within the tank is injected into the pocket means by a piston slidably mounted within the tank.

7. A combination according to claim 5 wherein said tank is disposed inside of the enclosure.

8. A combination according to claim 1, wherein said enclosure constitutes a cash box for an automatic banknote dispenser.

9. A combination according to claim 6 wherein said tank is located outside of said enclosure.

10. A combination according to claim 3 wherein the first means comprises at least one heating resistor wire.

11. A combination according to claim 3 wherein the first means is pyrotechnical.

12. A combination according to claim 3 wherein the first means is mechanical.

13. A combination according to claim 5 wherein the pocket means comprises fragile tubes.

14. A combination according to claim 5 wherein the defacing liquid contained within the tank is injected into the pocket means by pressurized ga that is released in the tank.

15. A combination according to claim 6 wherein said tank is disposed outside of said enclosure.

16. An automatic banknote dispenser including:

a plurality of cash boxes;

a stack of face-to-face banknotes disposed within each of said boxes and each of said banknotes being positioned in a generally vertical plane;

an individual spongy element within each of said boxes disposed above said stack in close proximity thereto; and means that is actuated upon a breach of security afforded by said dispense to supply defacing liquid to said spongy elements with said liquid migrating through said elements to the stacks at their upper surfaces and migrating between said documents to deface same.

* * * * *